US012648614B2

(12) United States Patent
Oleson et al.

(10) Patent No.: US 12,648,614 B2
(45) Date of Patent: Jun. 9, 2026

(54) FOOTWEAR

(71) Applicant: Avoli LLC, Portland, OR (US)

(72) Inventors: Mark Oleson, Portland, OR (US); Richard Anguilla, Portland, OR (US); Erik Hernandez, Portland, OR (US); Eldon Jones, III, Vancouver, WA (US); Samantha Noyes, Portland, OR (US)

(73) Assignee: Avoli, Inc., Portland, OR (US)

( * ) Notice: Subject to any disclaimer, the term of this patent is extended or adjusted under 35 U.S.C. 154(b) by 0 days.

(21) Appl. No.: 18/737,188

(22) Filed: Jun. 7, 2024

(65) Prior Publication Data

US 2024/0407498 A1 Dec. 12, 2024

Related U.S. Application Data

(60) Provisional application No. 63/507,396, filed on Jun. 9, 2023.

(51) Int. Cl.
*A43B 13/14* (2006.01)

(52) U.S. Cl.
CPC ..... *A43B 13/14* (2013.01)

(58) Field of Classification Search
CPC ..... A43B 7/087; A43B 7/082; A43B 7/084; A43B 7/08; A43B 17/08
USPC ..... 36/3 B
See application file for complete search history.

(56) References Cited

U.S. PATENT DOCUMENTS

| | | | | |
|---|---|---|---|---|
| 7,096,605 | B1 * | 8/2006 | Kozo | A43B 7/26 36/76 R |
| 2006/0162183 | A1 * | 7/2006 | Polegato Moretti | A43B 7/125 36/3 B |
| 2006/0168847 | A1 * | 8/2006 | Myers | A43B 13/16 36/103 |
| 2007/0011907 | A1 * | 1/2007 | Polegato Moretti | A43B 3/128 36/14 |
| 2007/0240333 | A1 * | 10/2007 | Le | A43B 17/10 36/103 |

FOREIGN PATENT DOCUMENTS

| | | | | |
|---|---|---|---|---|
| WO | WO-2020041719 | A1 * | 2/2020 | A43B 17/006 |

* cited by examiner

*Primary Examiner* — Ted Kavanaugh
(74) *Attorney, Agent, or Firm* — Kolitch Romano Dascenzo Gates LLP

(57) ABSTRACT

Footwear comprises a sole assembly having a ground-contacting side, and an upper coupled to the sole assembly opposite the ground-contacting side. The upper defines a foot compartment configured to receive a wearer's foot. The sole assembly defines a plurality of sole-assembly vents that extend through the sole assembly and that are open both to the ground-contacting side and to the foot compartment of the upper.

28 Claims, 13 Drawing Sheets

FOOTWEAR

RELATED APPLICATION

This application claims priority to U.S. Provisional Patent Application No. 63/507,396, filed on Jun. 9, 2023, and entitled FOOTWEAR, the complete disclosure of which is incorporated herein by reference.

FIELD

The present disclosure relates to footwear.

BACKGROUND

During volleyball play, volleyball players spend the majority of their time standing on their forefoots, and pivot, jump, and dive numerous times throughout volleyball play.

DESCRIPTION

Figure 1:
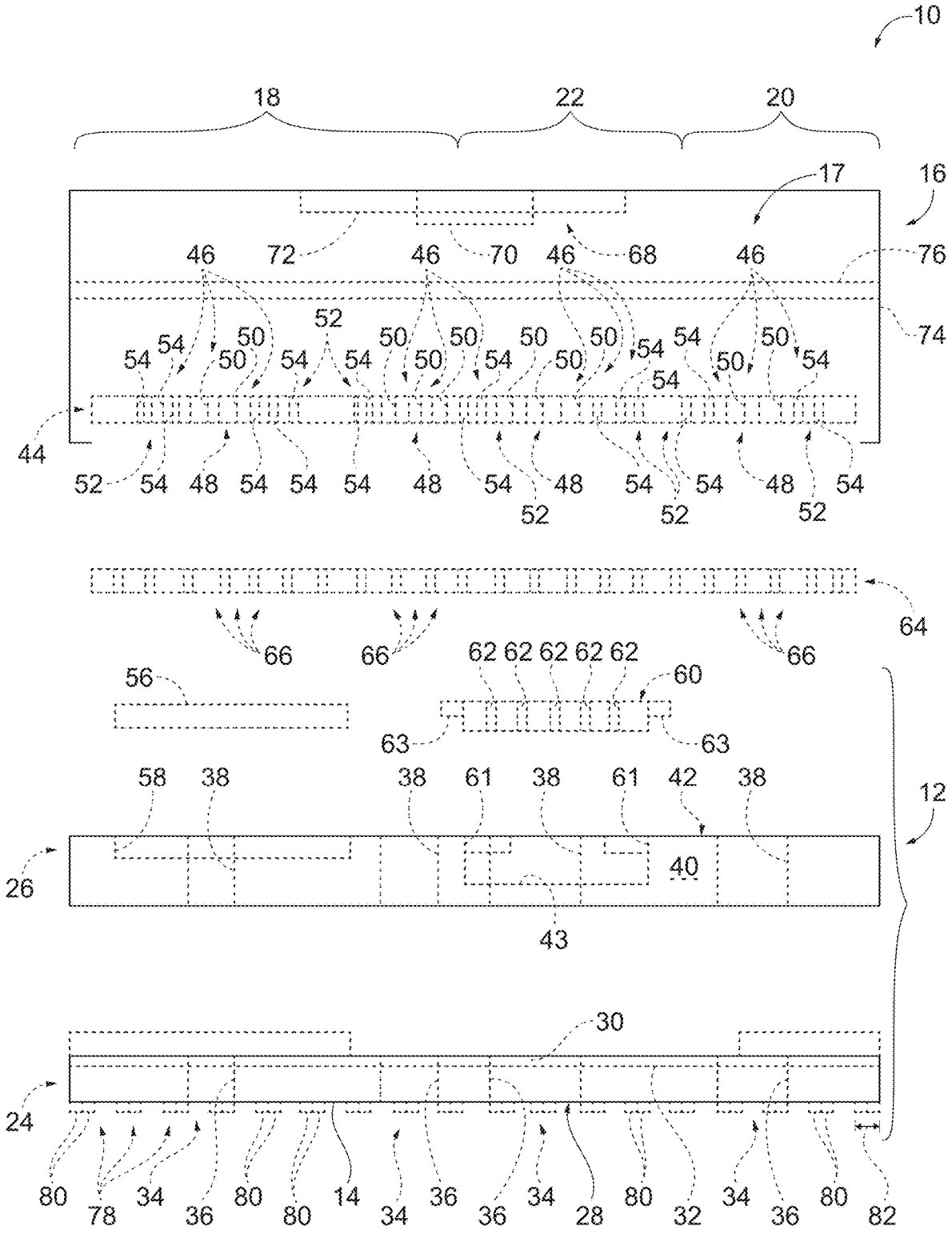
FIG. 1 is a schematic exploded side-view diagram representing footwear according to the present disclosure.

FIG. 1 illustrates footwear 10 according to the present disclosure in an exploded schematic side-view diagram. Footwear 10 may be described as athletic footwear, as court footwear, and/or as volleyball footwear. That is, some examples of footwear 10 are specifically configured for use by volleyball players. Some footwear 10 may be specifically shaped and sized for female wearers, although this is not required for all footwear 10 of the present disclosure.

Generally, in FIG. 1, elements that are likely to be included in footwear 10 are illustrated in solid lines, while elements that are optional or corresponding to one or more specific examples are illustrated in broken lines. However, elements that are illustrated in solid lines are not essential to all examples of footwear 10, and an element shown in solid lines may be omitted from a particular example without departing from the scope of the present disclosure. Herein, spatial terms, such as top, bottom, front, rear, side, medial, lateral, and the like are used to describe footwear 10 when generally on a flat service as would be worn by a wearer. The terms "medial," "lateral," "anterior," "posterior," and the like are intended to refer to anatomical directions corresponding to a human foot. For example, "medial" refers to a relative position disposed toward the center of the human body, while "lateral" refers to a relative position disposed away from the center of the human body. "Anterior" refers to a relative position closer to the toe of a wearer and "posterior" refers to a relative position closer to the heel of the wearer. In the absence of a wearer, the same directional terms may be used as if the footwear is being worn in its expected configuration.

As schematically represented in FIG. 1, footwear 10 generally comprises at least a sole assembly 12 and an upper 16 that is coupled to the sole assembly 12. The sole assembly 12 has a ground-contacting side 14, and the upper 16 is coupled to the sole assembly 12 opposite the ground-contacting side 14. The upper 16 and sole assembly 12 collectively define a foot compartment 17 configured to receive a wearer's foot. As schematically indicated, footwear 10 may be described as having a forefoot region 18, a heel region 20, and a midfoot region 22 between the forefoot region 18 and the heel region 20. Such regions generally correspond to corresponding regions of a wearer's foot when received within the foot compartment 17. Moreover, such regions of footwear 10 do not necessarily have distinct borders between them or edges and may overlap with one another. That is, most of the forefoot region 18 is positioned forward of most of the midfoot region 22, which is positioned forward of most of the heel region 20.

As schematically represented in FIG. 1, in some examples, the sole assembly 12 comprises an outsole 24 that defines the ground-contacting side 14, and a midsole 26 that is positioned above the outsole 24. With typical athletic footwear construction, the outsole 24 and the midsole 26 are distinct structures that are operatively coupled together, such as by adhesives and/or stitching. However, it is within the scope of footwear 10 that the outsole 24 and the midsole 26 may be integrally formed together.

As schematically represented in FIG. 1, in some examples in which the outsole 24 and the midsole 26 are distinct structures, the outsole 24 comprises an outsole body 28 that defines the ground-contacting side 14 of the sole assembly 12, and an outsole film 30 that is coupled to the outsole body 28 opposite the ground-contacting side 14. The outsole film 30 may be coupled to the outsole body 28 by any suitable mechanism, such as adhesive, lamination, and/or the like. In some examples, the outsole film 30 is coupled to outsole body 28 by the midsole 26 (i.e., the outsole film 30 is disposed within a compartment defined by the outsole body 28 and the midsole 26, but is not otherwise coupled to the outsole body 28). In some such examples, the outsole body 28 is transparent and the outsole film 30 is opaque. In this context, "transparent" refers to a body having the property of transmitting rays of light through its substance without appreciable scattering so that bodies situated beyond or behind can be distinctly seen. Accordingly, in such examples, the outsole film 30 may comprise indicia 32 that is visible through the transparent outsole body 28. Additionally or alternatively, the outsole film 30 may comprise a color and/or a pattern that is visible through the transparent outsole body 28. As a result, such footwear 10 may be constructed with branding, team logos, team colors, and the like on the outsole film 30. Construction of the outsole film 30, including custom outsole films 30, is much less expensive, and more easily implemented, than custom outsole bodies 28 having such customized indicia, colors, patterns, and the like.

In some examples of footwear 10, the outsole 24 extends upward around the midsole 26 within one or both of the forefoot region 18 and the heel region 20. Such examples provide extra protection and traction in such regions during athletic movements, such as typically are conducted during volleyball play. In addition, such examples may help to restrict a wearer's ankle from rolling and becoming injured.

In some examples of footwear 10, the outsole 24 extends above the midsole 26 within the forefoot region 18, such as forward of wearer's toes.

In some examples of footwear 10, the outsole 24 is rounded where the outsole 24 extends upward around the midsole 26 in the forefoot region 18 and/or in the heel region 20.

In some examples of footwear 10, the outsole 24 does not extend upward around the midsole 26 within the midfoot region 22.

With continued reference to FIG. 1, in some examples of footwear 10, the sole assembly 12 defines a plurality of sole-assembly vents 34 that extend through the sole assembly 12, that are open to the ground-contacting side 14, and that are open to the foot compartment 17 of the upper 16. That is, such footwear 10 may be described as having vertical ventilation to and from the foot compartment 17 through the sole assembly 12. Such configurations of footwear 10 are thus well suited for indoor athletic endeavors, such as court sports, including volleyball. The sole-assembly vents 34 generally may be uniform in size and shape or may vary in size and shape. As illustrative examples, one or more or all of the sole-assembly vents 34 may have a maximum lateral dimension in the range of 10 to 60 millimeters (mm), 10 to 50 mm, or 20 to 60 mm; however, maximum lateral dimensions outside of these ranges, including maximum lateral dimensions that are smaller than and larger than these ranges, also are within the scope of the present disclosure.

In such ventilated footwear 10, at least one sole-assembly vent 34 extends through one or more of the forefoot region 18, the midfoot region 22, and the heel region 20. The sole-assembly vents 34 may have any suitable position along a medial-lateral axis of footwear 10, such as disposed within a medial region of footwear 10, disposed within a lateral region of footwear 10, disposed generally along a midline of footwear 10, and/or the like. In some examples, at least one sole-assembly vent 34 extends through the forefoot region 18, the midfoot region 22, and the heel region 20 and each sole-assembly vent 34 is disposed generally along a midline of footwear 10. In examples of ventilated footwear 10 that comprise an outsole 24 and a midsole 26, as schematically represented in FIG. 1, the plurality of sole-assembly vents 34 comprises a plurality of outsole vent-portions 36 that are defined by the outsole 24, and a plurality of midsole vent-portions 38 that are defined by the midsole 26 and that are vertically aligned with the outsole vent-portions 36.

The operative coupling of the upper 16 to the sole assembly 12 may be accomplished using a variety of standard footwear construction techniques, such as gluing, stitching, cementing, adhering, injection-molding, additive manufacturing, and/or the like. In some examples, as schematically represented in FIG. 1, footwear 10 comprises an insole 64. The upper 16 is coupled to the insole 64 to define the foot compartment 17, and the upper 16 and the insole 64 are coupled to the sole assembly 12, such as with adhesives. An insole 64 also may be described as or referred to as a Strobel board. In some examples, footwear 10 is Strobel lasted, such that insole 64 is sewn to the upper 16 to define the foot compartment 17. In some examples, the upper 16 is board lasted, California lasted, slip lasted, and/or the like. In some examples, portions of the upper 16 overlap with portions of the midsole 26, such that portions of the upper 16 wrap around the foot of a wearer when footwear 10 is in use (i.e., worn by the wearer).

In some ventilated footwear 10 that comprise an insole 64, the insole 64 defines a plurality of insole vents 66, as schematically represented in FIG. 1. At least a subset of the insole vents 66 are vertically aligned with one or more of the sole-assembly vents 34 to provide air flow to and from the foot compartment 17. Accordingly, in examples of footwear 10 including insole 64, air flows directly through the sole-assembly vents 34 through the insole vents 66, thereby ventilating footwear 10. In some examples, the insole vents 66 span a majority of the insole 64 or substantially span an entirety of the insole 64. For example, the insole 64 may be constructed at least partially of a mesh material (e.g. a woven or knitted nylon or other fabric) that spans at least 75% of the insole 64, and in some examples 100% of the insole 64. During construction, adhesive may be utilized only around a perimeter region of the insole 64, so as to not block air flow through at least a majority, if not all, of the insole vents 66. In some examples, the insole 64 is reinforced around a perimeter of the insole 64 to facilitate adhering the insole 64 to the midsole 26, as well as to facilitate attachment of the insole 64 to the upper 16. In some examples, the insole 64 comprises additional layers of the material from which the insole 64 is constructed around the perimeter of the insole 64. In some examples, an additional material, such as a nylon or other fabric, a paperboard, or a fiberboard, may be utilized to define the perimeter of the insole 64 to facilitate attachment of the insole 64 to the upper 16 and to the midsole 26.

In some examples of ventilated footwear 10, at least one sole-assembly vent 34 is open to a lateral side 40 and/or to a medial side 42 of the sole assembly 12, such as within the midfoot region 22. Accordingly, in such examples of ventilated footwear 10, air flow through one or more of the sole-assembly vents 34 may be significantly more than with equivalent ventilated footwear 10 not having a sole-assembly vent 34 that is open to a lateral side 40 and/or to a medial side 42, as air flow through the sole assembly 12 would be limited to be via the ground-contacting side 14, which is often in contact with the ground. In such examples, the sole assembly 12 may be described as having a lateral/medial window or passage 43 that extends through the sole assembly 12. In some examples, at least a portion of a sidewall of the midsole 26 defines the passage(s) 43. In some examples, the passage(s) 43 are defined entirely by the midsole 26. In other words, all sides of the passage(s) 43 comprise portions of the midsole 26. However, in some examples, the insole 64, the upper 16, a sockliner 44 (described below), a moderator plate 60 (described below), and/or the like define portions of the passage(s) 43. Accordingly, the passage(s) 43 are defined by the midsole 26 and, for example, the moderator plate 60. In examples where footwear 10 includes an insole 64, the passage(s) 43 are in fluid communication both with at least one sole-assembly vent 34 and with the foot compartment 17 via the insole vents 66. The passage(s) 43 may have any suitable shape and/or size. In some examples, the passage 43 spans a width of the shoe (i.e., from the lateral side 40 to the medial side 42), such that components of the upper 16 (e.g., the insole 64, the sockliner 44, the moderator plate 60, etc.), are spaced apart from the midsole 26 by the passage 43. In some examples, portions of the passage(s) 43 defined by the midsole 26 define a substantially arcuate hollow, channel, or valley within the midsole 26. Accordingly, in these examples, the passage(s) 43 are defined in part by the moderator plate 60. As schematically illustrated in FIG. 1, some footwear 10 also comprises a sockliner 44 that is positioned within the upper 16 above the sole assembly 12. Sockliners 44 additionally or alternatively may be described as or referred to as footbeds. In some examples, although not required, the sockliner 44 is configured to be removable. In some examples of ventilated footwear 10 that comprise a sockliner 44, the sockliner 44 defines a plurality of sockliner vents 46 that extend vertically through the sockliner 44, with at least a subset being vertically aligned with the plurality of sole-assembly vents 34. Accordingly, at least a subset of the sockliner vents 46 is in fluid communication with the sole-assembly vents 34 to ensure air flow to and from the foot compartment 17. However, because sockliners 44 may not always be positioned in a single, distinct position within the upper 16 due to having been removed and reinserted and/or due to the regular forces applied to the sockliner 44 by a wearer's foot, the plurality of sockliner vents 46 may span more of the sockliner 44 than just where they are vertically aligned with the sole-assembly vents 34. That is, a specific sockliner vent 46 may be vertically aligned with a sole-assembly vent 34 in one instance and may be offset from the same sole-assembly vent 34 in another instance, such as due to movement of the sockliner 44 within the upper 16. Accordingly, sockliner vents 46 may define clusters, each centered at a respective sole-assembly vent 34, wherein a greatest concentration of sockliner vents 46 is disposed at portions of the sockliner 44 that are vertically aligned with a respective sole-assembly vent 34 when the sockliner is installed in a default position, and wherein sockliner vents 46 are less concentrated at portions of the sockliner 44 that are adjacent to, but not directly overlapping sole-assembly vents 34 when the sockliner is installed within footwear 10 in the default position. Concentration, as used herein, may refer to any suitable difference in permeability to air facilitated by the relative positions of sockliner vents 46. For example, sockliner vents 46 may differ in size, shape, numerical density, and/or any combination thereof. For example, a numerical density of sockliner vents 46 may be greater at a center of each cluster and lower at a periphery of each cluster.

In some such examples of ventilated footwear 10, the plurality of sockliner vents 46 have a plurality of different sizes. For example, the plurality of sockliner vents 46 may comprise a first subset 48 of larger sockliner vents 50 and a second subset 52 of smaller sockliner vents 54 that are smaller than the larger sockliner vents 50. In some such examples, at least a subset of the larger sockliner vents 50 are vertically aligned with the plurality of sole-assembly vents 34 to ensure maximum air flow. Stated differently, in some such examples, at least a subset of the larger sockliner vents 50 are concentrated above the plurality of sole-assembly vents 34. In some examples, subsets of the smaller sockliner vents 54 are clumped around respective sole-assembly vents 34 of the plurality of sole-assembly vents 34. In other words, first subset 48 and second subset 52 define a gradient of sockliner vents 46, with larger sockliner vents 50 concentrated at a center of the cluster of sockliner vents and with smaller sockliner vents 54 disposed radially adjacent to larger sockliner vents 50. Accordingly, if and when the sockliner 44 slides within the upper 16, a smaller sockliner vent 54 may move over a sole-assembly vent 34 and/or away from a sole-assembly vent 34. Because a clump (i.e. a subset) of smaller sockliner vents 46 are positioned around a sole-assembly vent 34, regardless of movement of the sockliner 44 in any direction within the upper 16, at any given time at least a subset of the sockliner vents 46 are vertically aligned with the sole-assembly vents 34. In some examples, at any given time, at least 50% of the sockliner vents 46, or at least 50% of the overall cross-sectional area of all of the sockliner vents 46, is positioned vertically above the sole-assembly vents 34.

As examples, the larger sockliner vents 50 may have a maximum lateral dimension (e.g., diameter) of 2-7 mm, and the smaller sockliner vents 54 may have a maximum lateral dimension (e.g., diameter) of 0.5-3 mm, although sizes outside of these ranges also may be incorporated into footwear 10. Sockliner vents 46 may be generally circular, but other shapes also may be utilized. Furthermore, while sockliner vents 46 are described in terms of larger sockliner vents 50 and smaller sockliner vents 54, sockliner vents 46 may include additional groups of vents having different sizes and/or shapes. For example, sockliner vents 46 may have three groups of vents having different sizes, four groups of vents having different sizes, six groups of vents having different sizes, and/or the like. Furthermore, while larger sockliner vents 50 may be generally clustered at the center of a cluster of sockliner vents, smaller sockliner vents 54 may be interspersed between larger sockliner vents 50, such that a concentration of the larger sockliner vents 50 is greater at the center of the cluster and a concentration of the smaller sockliner vents 54 is greater at a periphery of the cluster.

In some examples of footwear 10, the sockliner 44 is thicker in the forefoot region 18 than in the heel region 20. For example, as discussed, volleyball players spend most of their time on their forefeet, and therefore additional cushioning in the forefoot region 18 may be desired. Moreover, different configurations (e.g., thicknesses) of sockliners 44 may be selected based on the particular sport and even on the particular position played within a sport. For example, in volleyball, it may be preferable for the footwear of setters, blockers, defensive specialists, and hitters to have different cushioning characteristics.

Also, in ventilated footwear 10, compression of the sockliner 44 by a wearer's foot may serve as a pump above the sole-assembly vents 34. Compression of the sockliner 44 directly above a sole-assembly vent 34 pushes warm air out of the foot compartment 17, and expansion of the sockliner 44 directly above a sole-assembly vent 34 pulls cool air through the sole-assembly vent 34 and into the foot compartment 17. In addition, the repetitive movement of air through the sole-assembly vents 34 results in turbulent air movement around the footwear 10, serving to further distribute warm air from within and away from the footwear 10, as well as to dissipate humidity created by a wearer's foot. Ventilated footwear 10 may be described as having active ventilation. As the passage 43 may define a channel extending beneath the arch of a wearer's foot, active ventilation may facilitate movement of air through the passage 43. Accordingly, the sockliner 44 may comprise any suitable resilient material configured to compress and expand in response to movement of a wearer's foot, such as foams, resilient polymers, cork, rubber, and/or the like.

With continued reference to FIG. 1, in some examples of footwear 10, the sole assembly 12 comprises a forefoot dampener 56 that is positioned within the forefoot region 18. In some such examples, and as schematically represented in FIG. 1, the midsole 26 defines a forefoot-dampener recess 58, and the forefoot dampener 56 is positioned within the forefoot-dampener recess 58. In some such examples, the forefoot dampener 56 is adhered to the midsole 26, such as within the forefoot-dampener recess 58. In some examples, the midsole 26 has a higher spring rate than the forefoot dampener 56. Accordingly, while the midsole 26 acts as a spring under the wearer's foot, the forefoot dampener 56 acts as a dampener. This is particularly useful when such footwear 10 is worn for volleyball, which is a sport played predominantly on the forefeet of the players with a significant amount of jumping occurring during play. As an example, a forefoot dampener 56 may be constructed of polyurethane (PU), while a midsole 26 may be constructed of ethylene vinyl acetate (EVA). The specific material and dampening characteristics of the forefoot dampener 56 may be selected based on the particular sport and even on the particular position played within a sport. For example, in volleyball, it may be preferable for the footwear of setters, blockers, defensive specialists, and hitters to have different forefoot characteristics.

In some examples of ventilated footwear 10, the forefoot dampener 56 does not define a sole-assembly vent 34. That is, in ventilated footwear 10 with a forefoot dampener 56, the forefoot dampener 56 is spaced-away from the plurality of sole-assembly vents 34, including within the forefoot region 18. Accordingly, during assembly of such ventilated footwear 10, any adhesive used to adhere the forefoot dampener 56 to the midsole 26 will not enter a sole-assembly vent 34 in an undesirable manner. Accordingly, in some examples, the sole-assembly vent 34 and/or the forefoot dampener 56 may be spaced apart from a toe region of the footwear, to provide space for the forefoot dampener. Similarly, in some examples, the forefoot dampener 56 comprises one or more recess(es), inlet(s), or channel(s) configured to accommodate one or more sole-assembly vents 34.

With continued reference to FIG. 1, in some footwear 10, the sole assembly 12 comprises a moderator plate 60 that is positioned within the midfoot region 22. A moderator plate 60, when present, is more rigid than the midsole 26, spans a lateral/medial width of the midsole 26, and thus provides torsional stiffness to the footwear 10. In some examples, the moderator plate 60 is positioned vertically above the midsole 26, such that moderator plate 60 defines a lower side of foot compartment 17. In some such examples, and as schematically represented in FIG. 1, the midsole 26 defines one or more moderator-plate recesses 61, and the moderator plate 60 is positioned at least partially within the moderator-plate recess(es) 61. In these examples, the moderator plate 60 may define one or more peripheral flanges 63 configured to be received by the moderator plate recess(es) 61. In some examples, a thickness of the peripheral flanges 63 is less than a maximum thickness of the moderator plate 60. In some examples, the moderator plate 60 is adhered to the midsole 26 with adhesive.

In some ventilated footwear 10, and as schematically represented in FIG. 1, the moderator plate 60 defines a plurality of moderator-plate vents 62, at least a subset of which is positioned vertically above at least one sole-assembly vent 34. That is, at least a subset of the moderator-plate vents 62 are in fluid communication with at least one sole-assembly vent 34 to permit air to pass to and from a sole-assembly vent 34 through the moderator-plate vents 62. In some such examples, the moderator plate 60 borders a sole-assembly vent 34 that is open to the lateral side 40 and/or to the medial side 42 of the sole assembly 12. That is, the moderator plate 60 may at least partially define an upper side of a lateral/medial window or passage 43 that extends through the sole assembly 12.

In some examples where the moderator plate 60 defines an upper side of a lateral/medial window or passage 43, the moderator plate 60 is weight-bearing when footwear 10 is in use. In other words, as a wearer steps and the arch of a wearer's foot flattens, force may be applied to the moderator plate 60 and distributed to the midsole 26 via the peripheral flanges 63. In some examples where the moderator plate 60 defines an upper side of a lateral/medial window or passage 43, the moderator plate 60 reinforces the midsole 26, such that the forefoot region 18 and the heel region 20 have fixed positions relative to each other when footwear 10 is in use. In other words, in the absence of a moderator plate 60, the window or passage 43 would facilitate the flattening of the sole assembly 12, such that the forefoot region 18 moves in the anterior direction and that the heel region 20 moves in the posterior direction, increasing a length of the sole assembly 12 and decreasing a thickness of the sole assembly 12. In contrast, as the moderator plate 60 fixes an anterior/posterior length of the window or passage 43, the sole assembly 12 does not increase in length beyond a typical compression and expansion of the midsole 26. The moderator plate 60 may comprise any suitable substantially rigid material, such as metal, rigid plastics, such as polycarbonate, methacrylate, polypropylene, polystyrene, nylon, polyvinylidene chloride, acrylonitrile butadiene styrene, and/or the like. As volleyball players often perform high-impact movements, such as jumping, diving, and/or the like, the moderator plate 60 increases the supportiveness of footwear 10 while retaining ventilating properties provided by the sole-assembly vent(s) 34 and the lateral/medial window(s) or passage(s) 43.

In some examples of ventilated footwear 10, the moderator plate 60, such as a lower side thereof, is visible via a sole-assembly vent 34 that extends through the midfoot region 22. Accordingly, the moderator plate 60 may be utilized as an aesthetic design feature featuring a selected color, pattern, or indicia. As a result, such footwear 10 may be easily customized during the manufacturing process, such as by painting or otherwise applying a color or graphic to the underside of the moderator plate 60, such as based on a team color, branding, or the like. Moreover, a single tooling for molding moderator plates 60 may be used, with the color or graphic applied after the molding of the moderator plates 60, and thus without having to have distinct tooling for distinct colors or graphics.

With continued reference to FIG. 1, in some examples of footwear 10, the upper 16 comprises a retention system 68 that is configured to selectively retain the wearer's foot in the foot compartment 17. For example, the retention system 68 may comprise one or more of a lace system 72, a buckle system, a hook-and-loop fastener system, a cable and dial system (e.g. BOA™ system), a clasp system, a strap system, etc.

In some examples, and as schematically represented in FIG. 1, the retention system 68 comprises an elastic band 70 that extends across at least a portion of the midfoot region 22 and is configured to extend across the midfoot of a wearer. Such an elastic band 70 may be described as a proprioception band and may be provided to give the wearer a sense of securement within the footwear 10 such that the wearer does not over tighten the retention system 68 (e.g., does not pull a lace system 72 too tight). In particular, historically, female volleyball players have needed to wear basketball or other court shoes designed for male athletes. Such court shoes often have large foot compartments that are too big for typical female feet. Accordingly, female wearers of such court shoes often are required to overtighten the laces to ensure a snug fit. Footwear 10 with an elastic band 70 provides the wearer with a sense of snug fit, resulting in the wearer not overtightening the retention system 68.

In some such examples of footwear 10 with an upper 16 comprising a lace system 72, the elastic band 70 extends beneath the lace system 72.

With continued reference to FIG. 1, in some examples of footwear 10, the upper 16 comprises an upper base 74 and an upper cage 76 that is coupled to an external side of the upper base 74. When present, the upper cage 76 is stiffer than the upper base 74 and serves to generally define and/or maintain a shape of the upper 16 and thus a shape of the foot compartment 17. In some examples, the upper base 74 and the upper cage 76 are configured to provide ventilation to the foot compartment 17. As examples, the upper base 74 may be constructed of typical athletic footwear materials, and the upper cage 76 may be constructed of polyurethane (PU) or other material.

Figure 2:
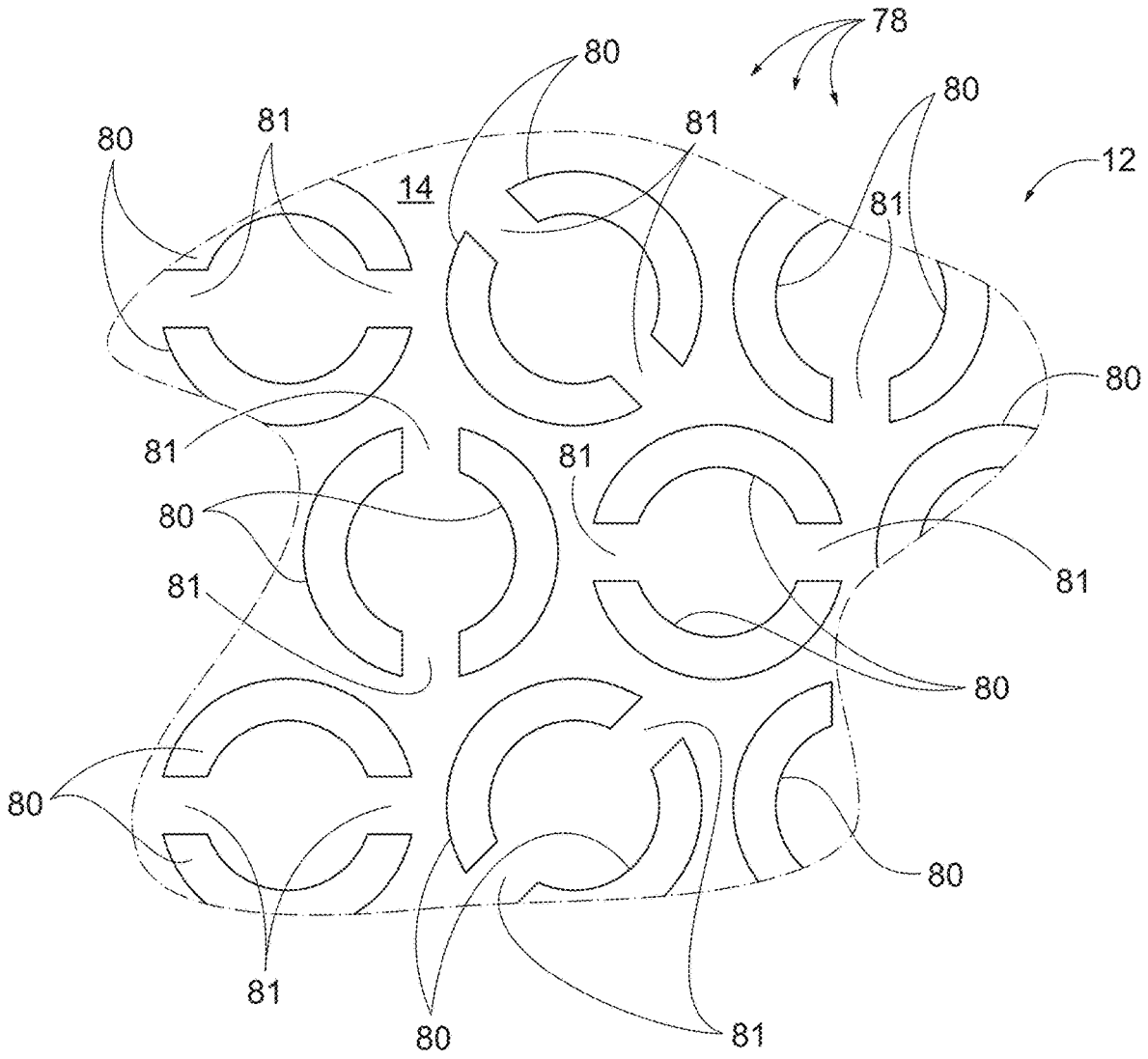
FIG. 2 is a schematic diagram representing example traction features of footwear according to the present disclosure.

With continued reference to FIG. 1 and as schematically represented, in some examples of footwear 10, the sole assembly 12 comprises a plurality of traction features 78 on the ground-contacting side 14. In some examples, each traction feature 78 of the plurality of traction features 78 has a generally circular, ovular, or elliptical shape and may be described as or referred to as lugs. As schematically represented in FIG. 2, in some examples, each traction feature 78 comprises a pair of arcuate projections, or lug portions, 80. In some such examples, each arcuate projection 80 of the pair of arcuate projection 80 are spaced-apart from each other and are concave toward each other. In some examples, each pair of arcuate projections 80 defines a pair of gaps 81, and in some such examples, each gap 81 of a given traction feature 78 is not aligned with a gap 81 of an adjacent traction feature 78, as generally represented in FIG. 2.

In some examples, the arcuate projections 80 have generally rectangular cross-sectional profiles. In some such examples, the edges of the arcuate projections are somewhat sharp with radii of curvatures less than 1 mm.

As examples, each traction feature 78 of the plurality of traction features 78 may have an outermost dimension 82 that is less than 20 mm, less than 15 mm, or less than 10 mm. In some examples, each traction feature 78 is within 5 mm of another traction feature 78. In some examples, each traction feature 78 has a depth that is less than 3 mm. In some examples, each traction feature 78 is configured to deform against a ground surface when the footwear 10 is worn by the wearer and is urged against the ground surface.

In some examples, the arcuate projections 80 of each pair of arcuate projections 80 are configured to deform in opposite directions when the footwear 10 is worn by the wearer and is urged against the ground surface.

In some examples of footwear 10, the sole assembly 12 does not have any straight-line tread features.

In some examples of footwear 10, the sole assembly 12 does not have a heel-kick feature.

Also within the scope of the present disclosure are methods of manufacturing footwear 10 comprising at least operatively coupling the upper 16 to the sole assembly 12. Some methods comprise assembling the sole assembly 12. Some methods comprise forming the various components of the footwear. Some methods comprise selecting aesthetic features, such as color and indicia for one or more of the outsole film 30, the moderator plate 60, the upper 16, and the sockliner 44.

Turning now to FIGS. 3-13, an illustrative non-exclusive example of footwear 10 in the form of footwear 100 is illustrated. Where appropriate, the reference numerals from the schematic illustrations of FIGS. 1 and 2 are used to designate corresponding parts of footwear 100; however, the example of FIGS. 3-13 is non-exclusive and does not limit footwear 10 to the illustrated embodiment of footwear 100. That is, footwear 10 are not limited to the specific embodiment of the illustrated footwear 100, and footwear 10 may incorporate any number of the various aspects, configurations, characteristics, properties, etc. of footwear 10 that are illustrated in and discussed with reference to the schematic representations of FIGS. 1 and 2 and/or the embodiment of FIGS. 3-13, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to footwear 100; however, it is within the scope of the present disclosure that the previously discussed features, variants, etc. may be utilized with footwear 100.

Figure 3:
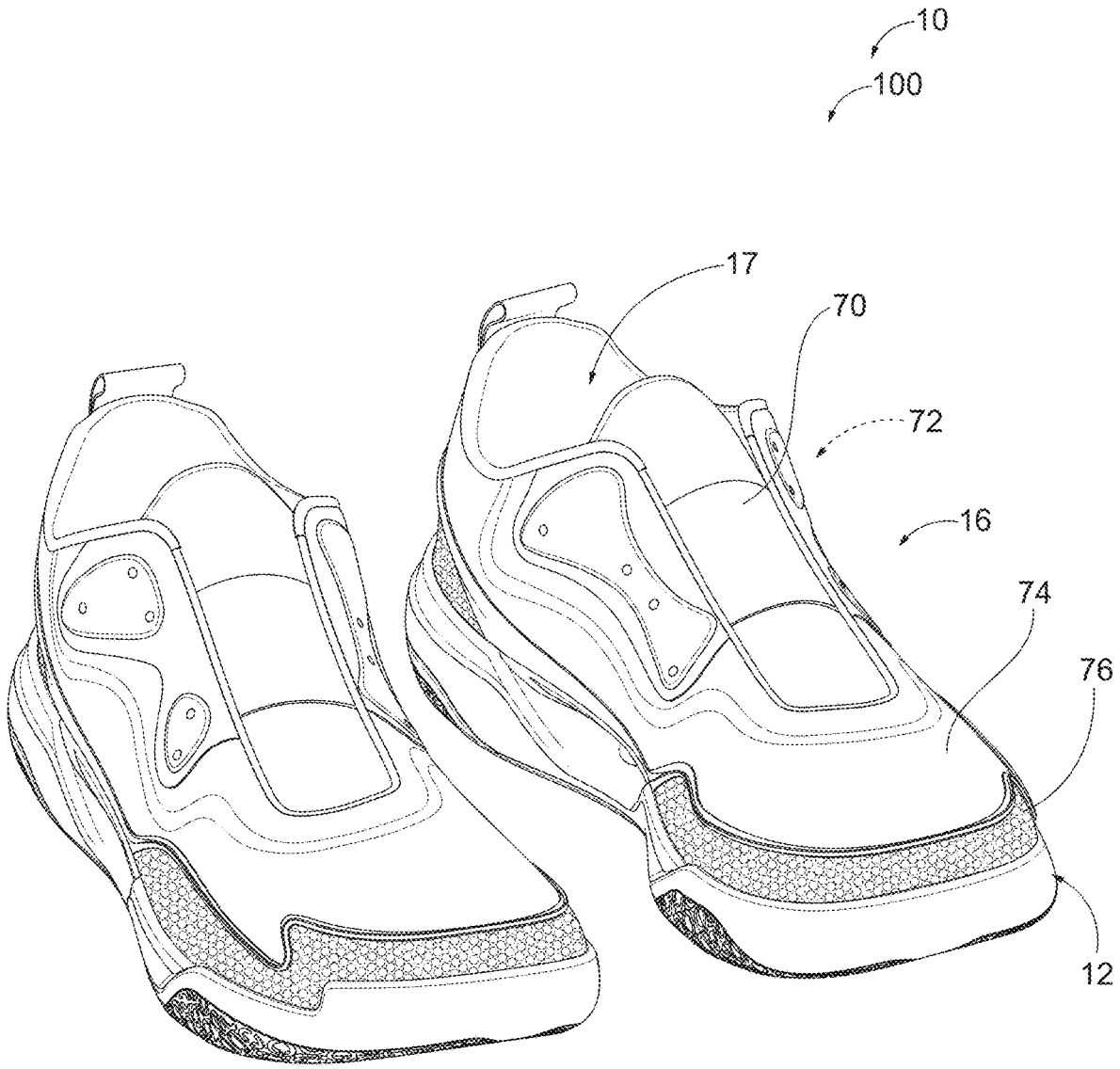
FIG. 3 is perspective view of an example footwear pair according to the present disclosure.
Figure 4:
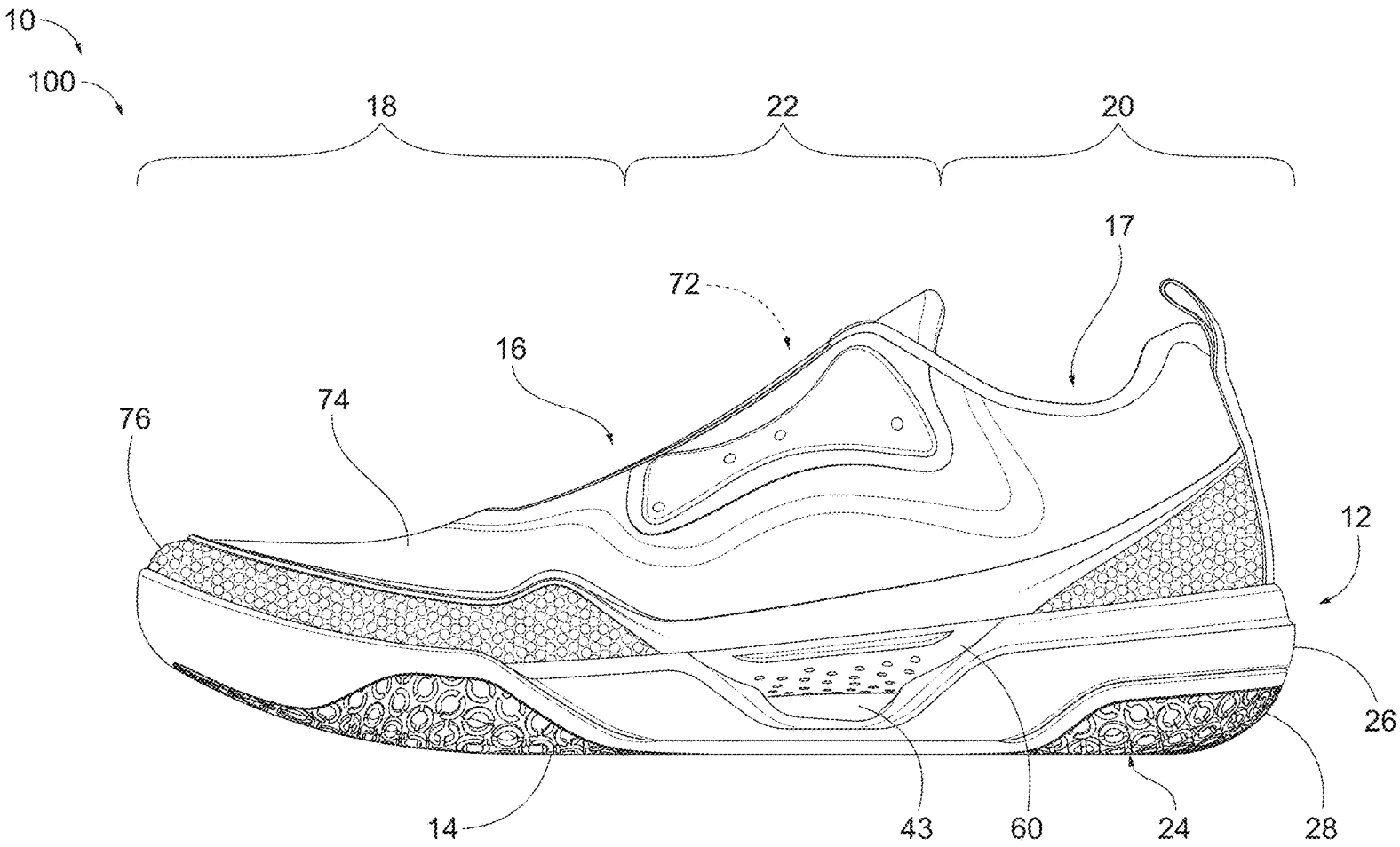
FIG. 4 is a medial side view of the right footwear of the footwear pair of FIG. 3.
Figure 5:
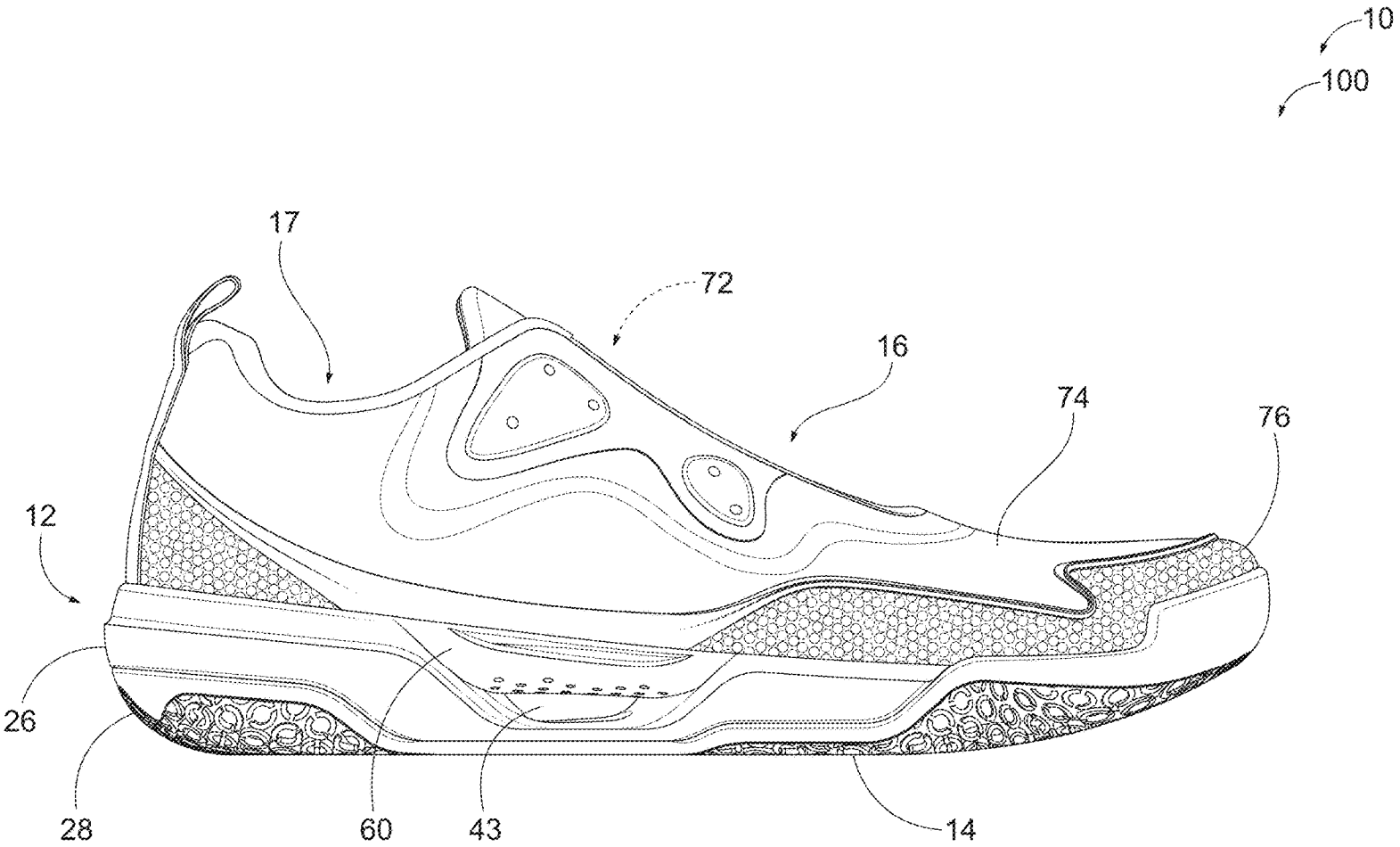
FIG. 5 is a lateral side view of the footwear of FIG. 4.
Figure 6:
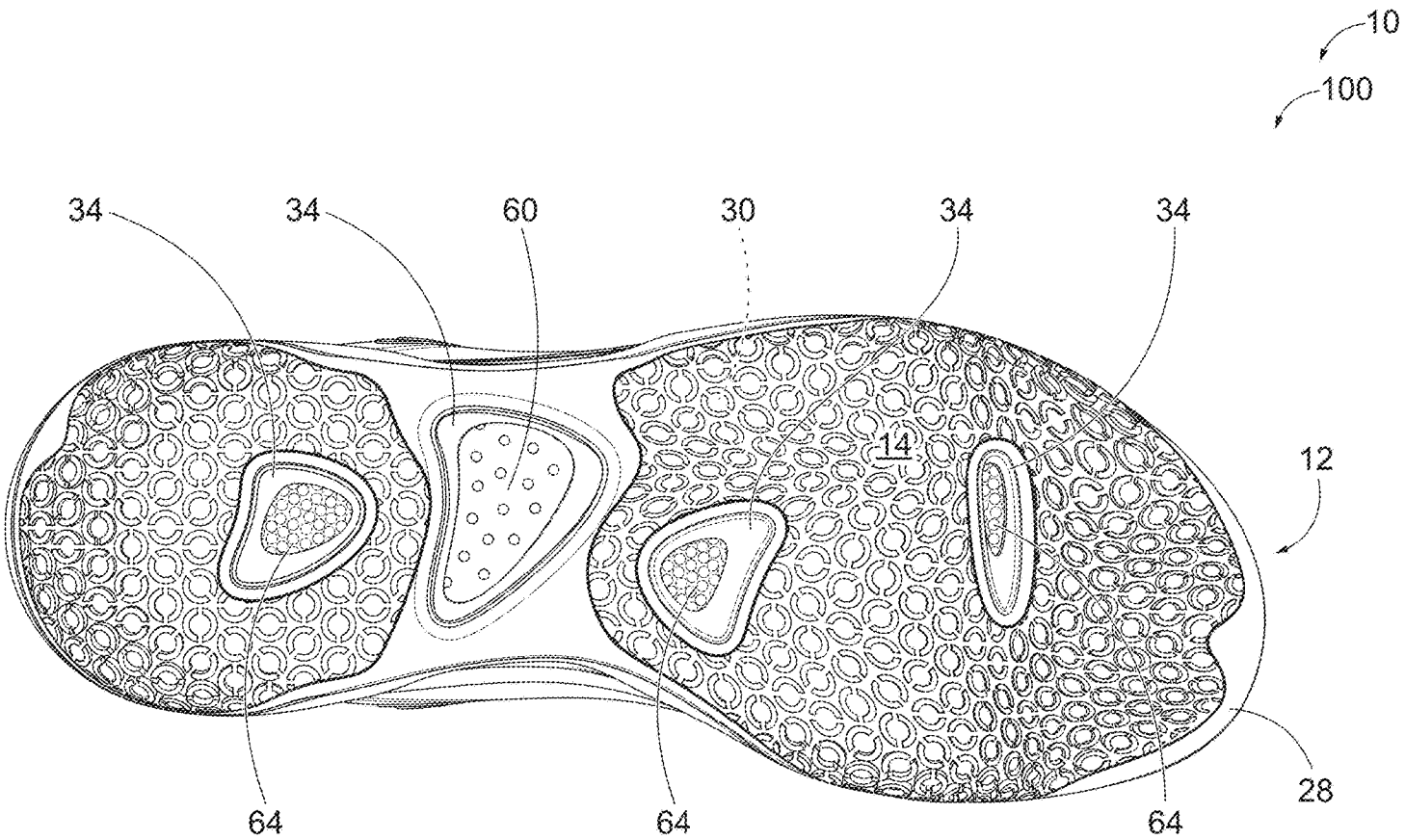
FIG. 6 is a bottom view of the footwear of FIG. 4.
Figure 7:
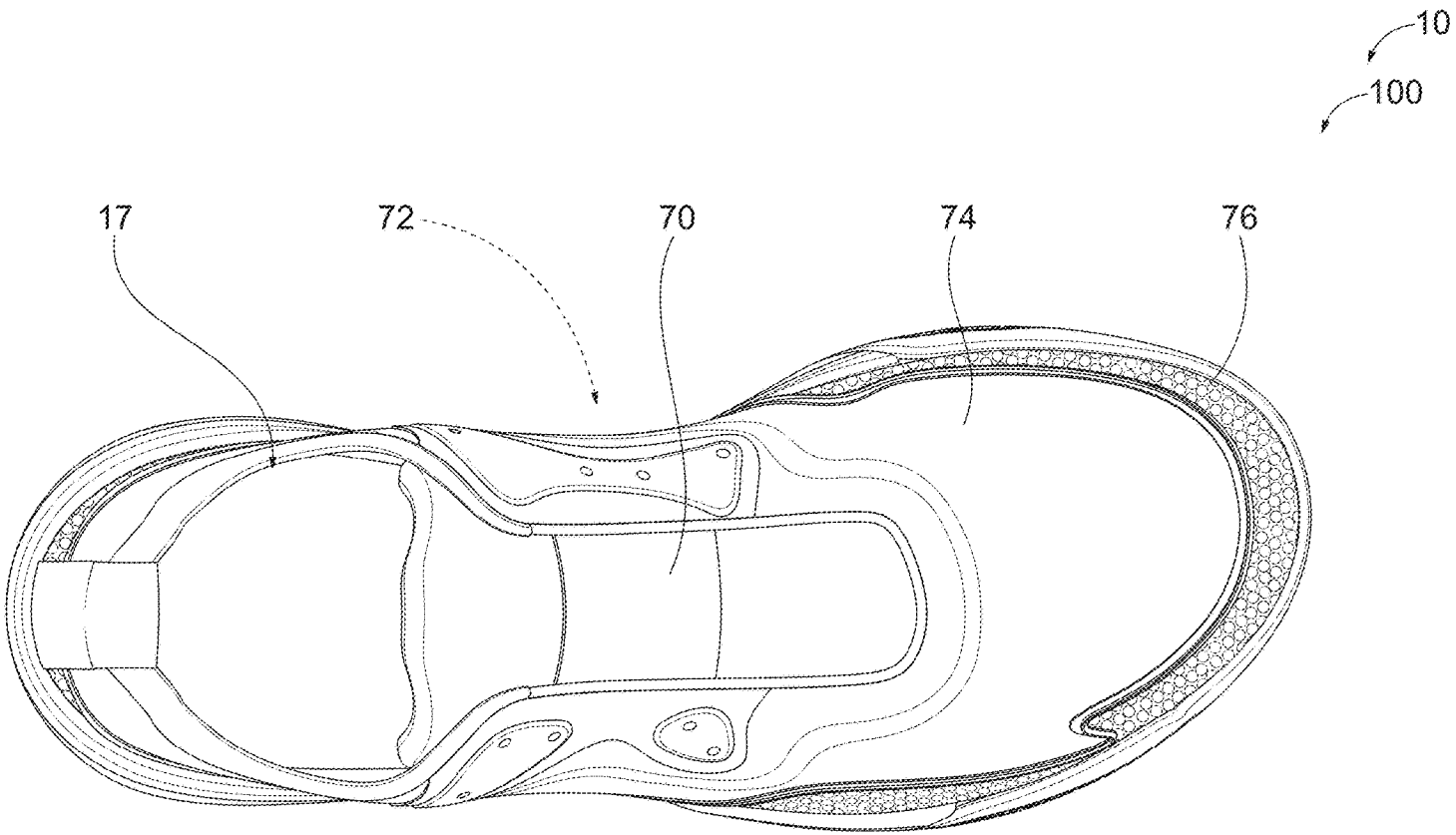
FIG. 7 is a top view of the footwear of FIG. 4.
Figure 8:
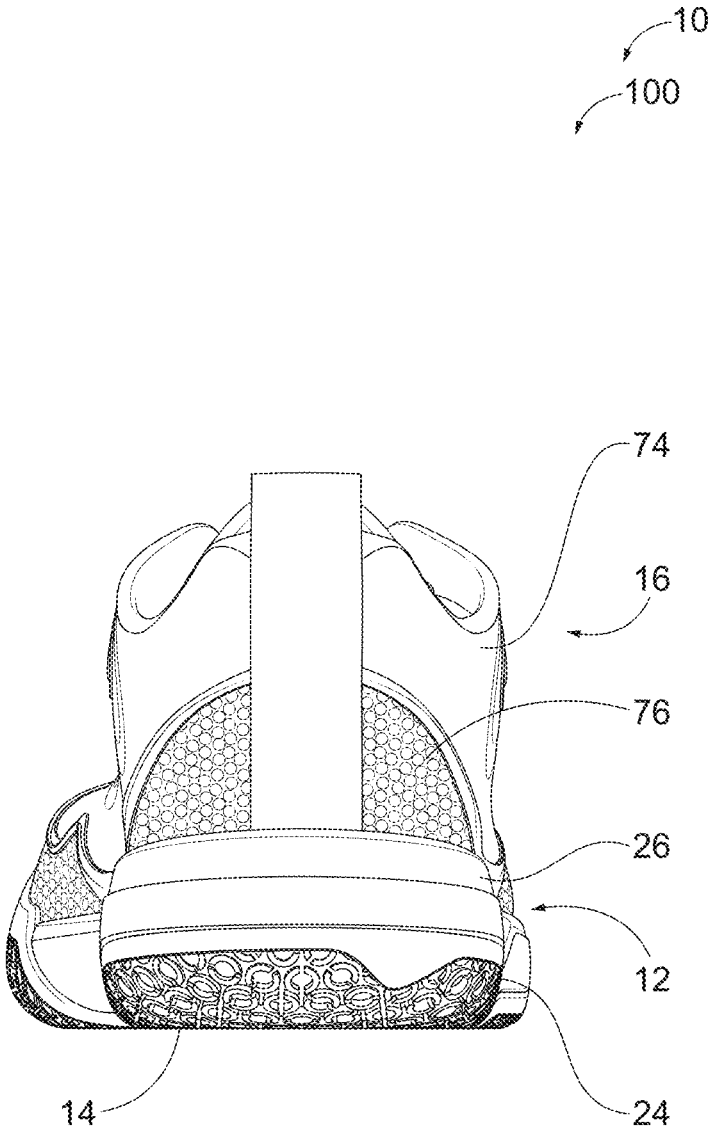
FIG. 8 is a rear view of the footwear of FIG. 4.
Figure 9:
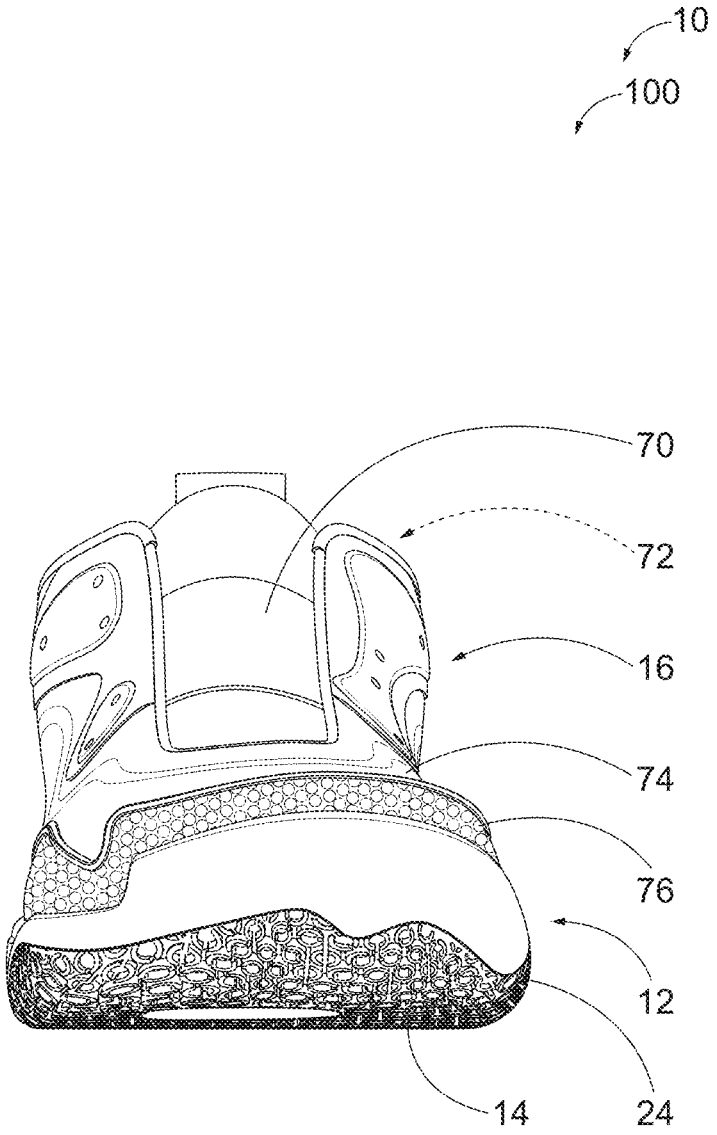
FIG. 9 is a front view of the footwear of FIG. 4.
Figure 10:
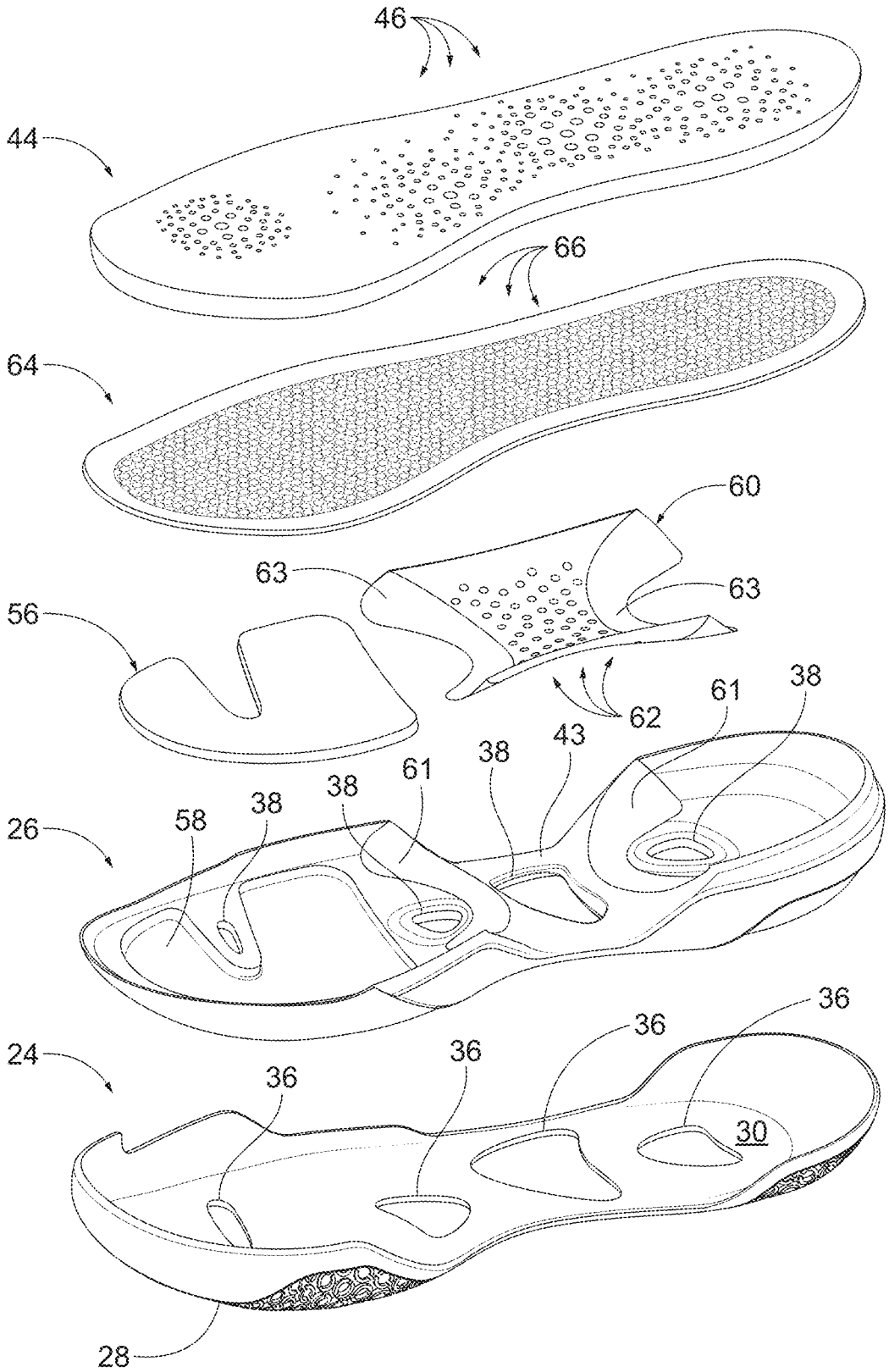
FIG. 10 is a perspective exploded view of the sole assembly of the footwear of FIG. 4.
Figure 11:
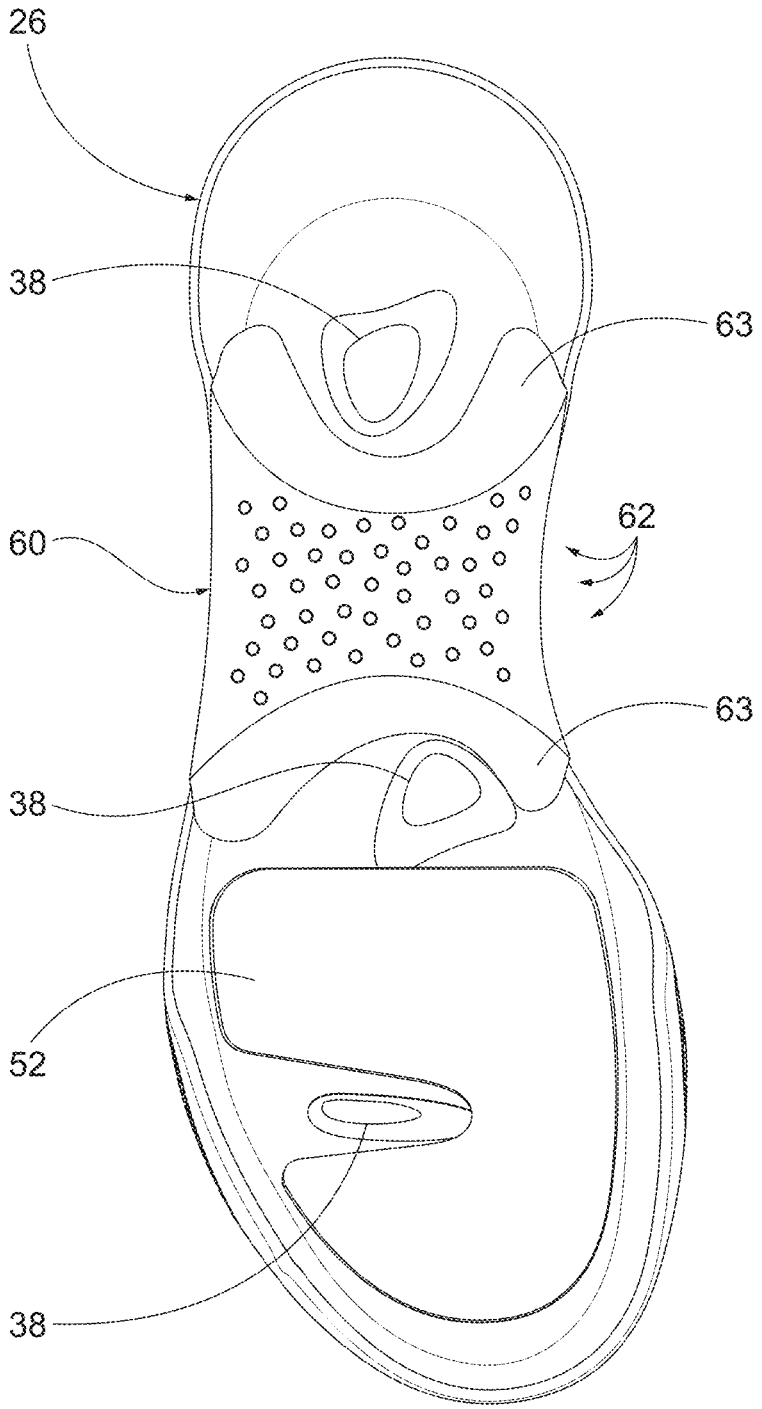
FIG. 11 is a top view of the moderator plate and the forefoot dampener of the footwear of FIG. 4, as received by the midsole of the footwear of FIG. 4.
Figure 12:
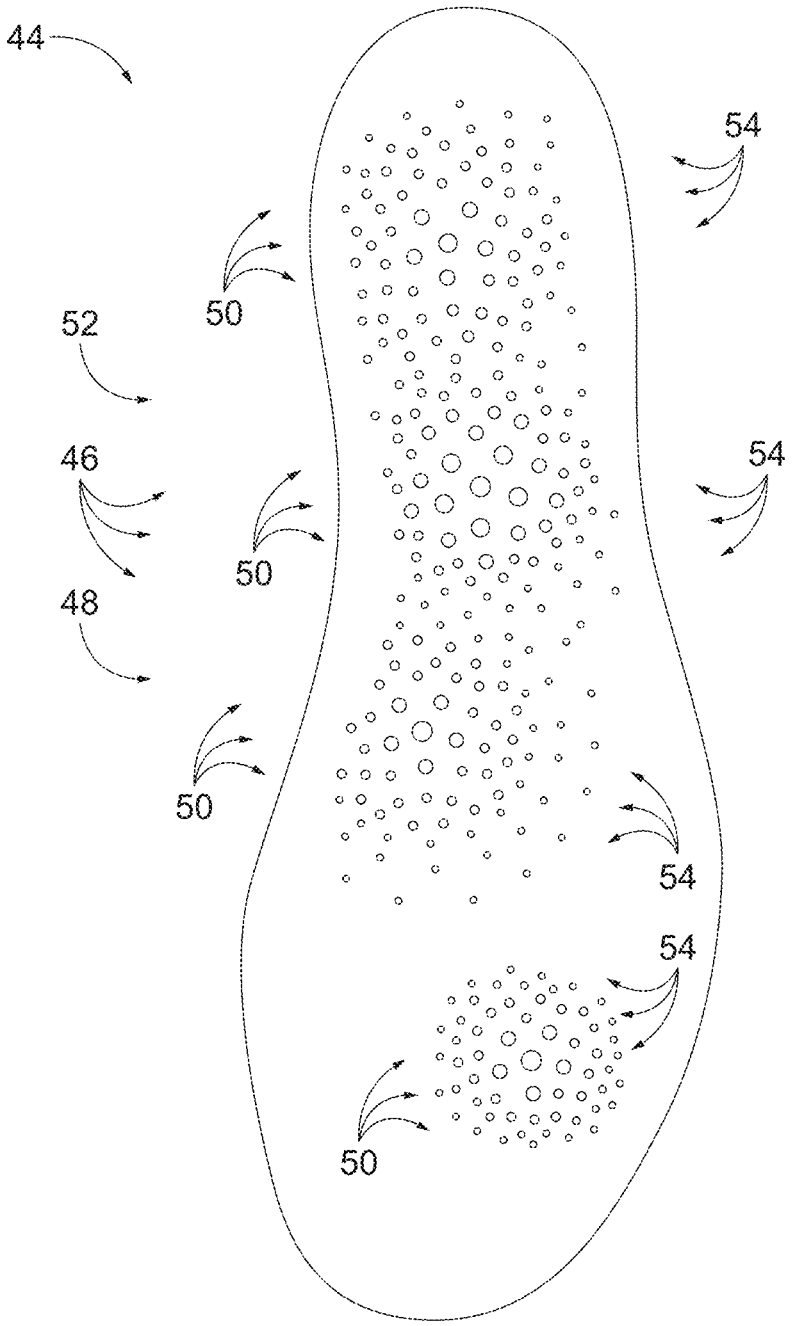
FIG. 12 is a bottom view of the sockliner of the footwear of FIG. 4.
Figure 13:
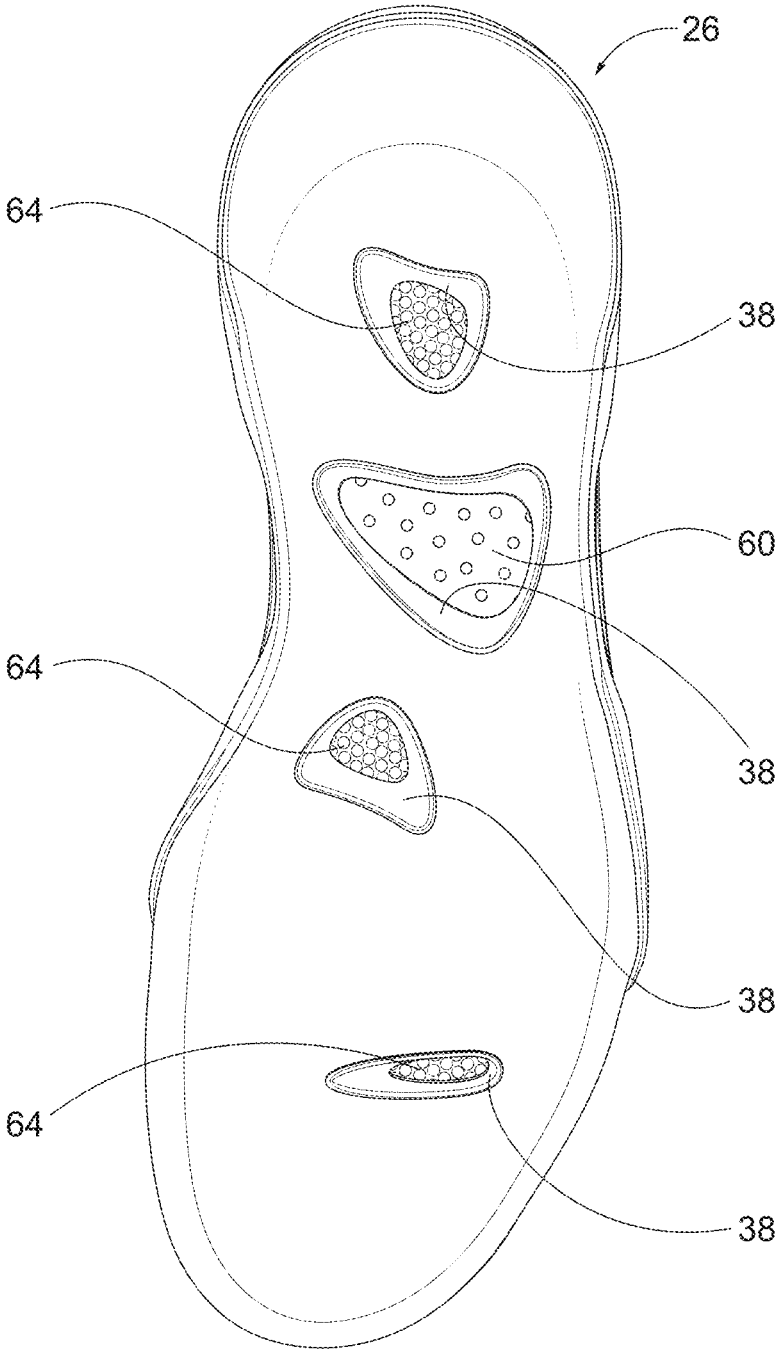
FIG. 13 is a bottom view of the midsole of the footwear of FIG. 4, overlaid over the insole and moderator plate of the footwear of FIG. 4.

As understood with reference to FIGS. 3-13, footwear 100 is an example of a footwear 10 that generally includes all of the various features discussed herein. FIG. 3 depicts a perspective view of a pair of footwear 10, comprising a sole assembly 12 and an upper 16 that is coupled to the sole assembly 12. As is visible in the side view depicted in FIG. 4, the sole assembly 12 has a ground-contacting side 14, and the upper 16 is coupled to the sole assembly 12 opposite ground-contacting side 14. In some examples, the sole assembly 12 further comprises an outsole 24 defining ground-contacting side 14, and a midsole positioned above the outsole 24.

Illustrative, non-exclusive examples of inventive subject matter according to the present disclosure are described in the following enumerated paragraphs:

A. Footwear (10), comprising:

a sole assembly (12) having a ground-contacting side (14); and an upper (16) coupled to the sole assembly (12) opposite the ground-contacting side (14) and defining a foot compartment (17) configured to receive a wearer's foot;

wherein the footwear (10) has a forefoot region (18), a heel region (20), and a midfoot region (22) between the forefoot region (18) and the heel region (20).

A1. The footwear (10) of paragraph A, wherein the sole assembly (12) comprises:

an outsole (24) that defines the ground-contacting side (14); and a midsole (26) positioned above the outsole (24).

A1.1. The footwear (10) of paragraph A1, wherein the outsole (24) comprises:

an outsole body (28) that defines the ground-contacting side (14) of the sole assembly (12); and an outsole film (30) coupled to the outsole body (28) opposite the ground-contacting side (14).

A1.1.1. The footwear (10) of paragraph A1.1., wherein the outsole body (28) is transparent and the outsole film (30) is opaque.

A1.1.2. The footwear (10) of any of paragraphs A1.1-A1.1.1, wherein the outsole body (28) is transparent and the outsole film (30) comprises indicia (32) visible through the outsole body (28).

A1.2. The footwear (10) of any of paragraphs A1-A1.1.2, wherein, within the forefoot region (18), the outsole (24) extends upward around the midsole (26).

A1.2.1. The footwear (10) of paragraph A1.2, wherein, within the forefoot region (18), the outsole (24) extends above the midsole (26).

A1.2.2. The footwear (10) of any of paragraphs A1.2-A1.2.1, wherein, within the forefoot region (18), the outsole (24) is rounded where the outsole (24) extends upward around the midsole (26).

A1.3. The footwear (10) of any of paragraphs A1-A1.2.2, wherein, within the heel region (20), the outsole (24) extends upward around the midsole (26).

A1.3.1. The footwear (10) of paragraph A1.3, wherein, within the heel region (20), the outsole (24) is rounded where the outsole (24) extends upward around the midsole (26).

A1.4. The footwear (10) of any of paragraphs A1-A1.3.1, wherein, within the midfoot region (22), the outsole (24) does not extend upward around the midsole (26).

A2. The footwear (10) of any of paragraphs A-A1.4, wherein the sole assembly (12) defines a plurality of sole-assembly vents (34) extending through the sole assembly (12) and open to the ground-contacting side (14) and to the foot compartment (17) of the upper (16).

A2.1. The footwear (10) of paragraph A2, wherein at least one sole-assembly vent (34) of the plurality of sole-assembly vents (34) extends through the forefoot region (18).

A2.2. The footwear (10) of any of paragraphs A2-A2.1, wherein at least one sole-assembly vent (34) of the plurality of sole-assembly vents (34) extends through the midfoot region (22).

A2.3. The footwear (10) of any of paragraphs A2-A2.1, wherein at least one sole-assembly vent (34) of the plurality of sole-assembly vents (34) extends through the heel region (20).

A2.4. The footwear (10) of any of paragraphs A2-A2.3 when depending from paragraph A1, wherein the plurality of sole-assembly vents (34) comprises a plurality of outsole vent-portions (36) defined by the outsole (24); and wherein the plurality of sole-assembly vents (34) comprises a plurality of midsole vent-portions (38) defined by the midsole (26) and vertically aligned with the outsole vent-portions (36).

A2.5. The footwear (10) of any of paragraphs A2-A2.4, wherein at least one sole-assembly vent (34) of the plurality of sole-assembly vents (34) is open to a lateral side (40) and/or to a medial side (42) of the sole assembly (12).

A2.5.1. The footwear (10) of paragraph A2.5, wherein the at least one sole-assembly vent (34) of the plurality of sole-assembly vents (34) that is open to the lateral side (40) and/or to the medial side (42) of the sole assembly (12) is positioned within the midfoot region (22).

A2.5.2. The footwear (10) of paragraph A2.5 or A2.5.1, wherein the at least one sole-assembly vent (34) of the plurality of sole-assembly vents (34) is open to both the lateral side (40) and to the medial side (42) of the sole assembly (12), such that the at least one sole-assembly vent (34) defines a passage (43) extending from the lateral side (40) to the medial side (42) of the sole assembly.

A2.6. The footwear (10) of any of paragraphs A2-A2.5.2, further comprising a sockliner (44) positioned within the upper (16) above the sole assembly (12), wherein the sockliner (44) defines a plurality of sockliner vents (46) extending through the sockliner (44), and wherein at least a subset of the plurality of sockliner vents (46) is vertically aligned with the plurality of sole-assembly vents (34).

A2.6.1. The footwear (10) of paragraph A2.6, wherein the plurality of sockliner vents (46) have a plurality of different sizes.

A2.6.1.1. The footwear (10) of paragraph A2.6.1, wherein the plurality of sockliner vents (46) comprises a first subset (48) of larger sockliner vents (50) and a second subset (52) of smaller sockliner vents (54), wherein the larger sockliner vents (50) are larger than the smaller sockliner vents (54).

A2.6.1.1.1. The footwear (10) of paragraph A2.6.1.1, wherein the larger sockliner vents (50) of at least a subset of the first subset (48) of the larger sockliner vents (50) are vertically aligned with the plurality of sole-assembly vents (34).

A2.6.1.1.2. The footwear (10) of any of paragraphs A2.6.1.1-A2.6.1.1.1, wherein the larger sockliner vents (50) of at least a/the subset of the larger sockliner vents (50) are concentrated above the plurality of sole-assembly vents (34).

A2.6.1.1.3. The footwear (10) of any of paragraphs A2.6.1.1-A2.6.1.1.2, wherein subsets of the second subset (52) of smaller sockliner vents (54) are clumped around respective sole-assembly vents (34) of the plurality of sole-assembly vents (34).

A2.6.1.1.4. The footwear (10) of any of paragraphs A2.6.1.1-A2.6.1.1.3, wherein the larger sockliner vents (50) have a maximum lateral dimension of 2-7 millimeters (mm).

A2.6.1.1.5. The footwear (10) of any of paragraphs A2.6.1.1-A2.6.1.1.4, wherein the smaller sockliner vents (54) have a maximum lateral dimension of 0.5-3 mm.

A3. The footwear (10) of any of paragraphs A-A2.6.1.1.5, wherein the sole assembly (12) comprises a forefoot dampener (56) positioned within the forefoot region (18).

A3.1. The footwear (10) of paragraph A3 when depending from paragraph A1, wherein the midsole (26) defines a forefoot-dampener recess (58), and wherein the forefoot dampener (56) is positioned within the forefoot-dampener recess (58).

A3.1.1. The footwear (10) of A3.1, wherein the forefoot dampener (56) is adhered to the midsole (26).

A3.2. The footwear (10) of any of paragraphs A3-A3.1.1 when depending from paragraph A1, wherein the midsole (26) has a higher spring rate than the forefoot dampener (56).

A3.3. The footwear (10) of any of paragraphs A3-A3.2 when depending from paragraph A2, wherein the forefoot dampener (56) does not define a sole-assembly vent (34) of the plurality of sole-assembly vents (34).

A3.4. The footwear (10) of any of paragraphs A3-A3.3 when depending from paragraph A2, wherein the forefoot dampener (56) is spaced-away from the plurality of sole-assembly vents (34).

A4. The footwear (10) of any of paragraphs A-A3.4, wherein the sole assembly (12) comprises a moderator plate (60) positioned within the midfoot region (22).

A4.1. The footwear (10) of paragraph A4 when depending from paragraph A1, wherein the moderator plate (60) is positioned vertically above the midsole (26).

A4.1.1. The footwear (10) of paragraph A4.1, wherein the midsole (26) defines a moderator-plate recess or recesses (61), and wherein the moderator plate (60) is positioned at least partially within the moderator-plate recess or recesses (61).

A4.2. The footwear (10) of any of paragraphs A4-A4.1.1 when depending from paragraph A1, wherein the moderator plate (60) is adhered to the midsole (26).

A4.3. The footwear (10) of any of paragraphs A4-A4.2 when depending from paragraph A2, wherein the moderator plate (60) defines a plurality of moderator-plate vents (62), wherein at least a subset of the moderator-plate vents (62) is positioned vertically above at least one sole-assembly vent (34) of the plurality of sole-assembly vents (34).

A4.3.1. The footwear (10) of paragraph A4.3 when depending from paragraph A2.5, wherein the moderator plate (60) borders the at least one sole-assembly vent (34) of the plurality of sole-assembly vents (34) that is open to the lateral side (40) and/or to the medial side (42) of the sole assembly (12). A4.3.2. The footwear (10) of any of paragraphs A4.3-A4.3.1 when depending from paragraph A2.2, wherein the moderator plate (60) is visible through the at least one sole-assembly vent (34) of the plurality of sole-assembly vents (34) that extends through the midfoot region (22).

A4.4. The footwear (10) of any of paragraphs A4-A4.3.2 when depending from paragraph A1, wherein the moderator plate (60) is more rigid than the midsole (26).

A5. The footwear (10) of any of paragraphs A-A4.4, further comprising an insole (64), wherein the upper (16) is coupled to the insole (64) to define the foot compartment (17), and wherein the upper (16) and the insole (64) are coupled to the sole assembly (12).

A5.1. The footwear (10) of paragraph A5, wherein the insole (64) defines a plurality of insole vents (66).

A5.1.1. The footwear (10) of paragraph A5.1, wherein the plurality of insole vents (66) span a majority of the insole (64).

A5.2. The footwear (10) of any of paragraphs A5-A5.1.1, wherein the insole (64) is constructed at least partially of a mesh material, and wherein the mesh material spans at least 75% of the insole (64).

A6. The footwear (10) of any of paragraphs A-A5.2, wherein the upper (16) comprises a retention system (68) configured to selectively retain the wearer's foot in the foot compartment (17).

A6.1. The footwear (10) of paragraph A6, wherein the retention system (68) comprises an elastic band (70) that extends across at least a portion of the midfoot region (22).

A6.2. The footwear (10) of any of paragraphs A6-A6.1, wherein the retention system (68) comprises a lace system (72).

A6.2.1. The footwear (10) of paragraph A6.2 when depending from paragraph A6.1, wherein the elastic band (70) extends beneath the lace system (72).

A7. The footwear (10) of any of paragraphs A-A6.2.1, wherein the upper (16) comprises an upper base (74) and an upper cage (76) coupled to an external side of the upper base (74).

A7.1. The footwear (10) of paragraph A7, wherein the upper base (74) and the upper cage (76) are configured to provide ventilation to the foot compartment (17).

A8. The footwear (10) of any of paragraphs A-A7.1, wherein the sole assembly (12) comprises a plurality of traction features (78) on the ground-contacting side (14), wherein each traction feature (78) of the plurality of traction features (78) has a generally circular, ovular, or elliptical shape.

A8.1. The footwear (10) of paragraph A8, wherein each traction feature (78) of the plurality of traction features (78) comprises a pair of arcuate projections (80).

A8.1.1. The footwear (10) of paragraph A8.1, wherein the arcuate projections (80) of each pair of arcuate projections (80) are spaced-apart and concave toward each other.

A8.1.2. The footwear (10) of any of paragraphs A8.1-A8.1.1, wherein each pair of arcuate projections (80) defines a pair of gaps (81).

A8.1.2.1. The footwear (10) of paragraph A8.1.2, wherein each gap (81) of the pair of gaps (81) of each pair of arcuate projections (80) of each traction feature (78) of the plurality of traction features (78) is not aligned with a gap (81) of an adjacent traction feature (78).

A8.2. The footwear (10) of any of paragraphs A8-A1.2.1, wherein each traction feature (78) of the plurality of traction features (78) has an outermost dimension (82) that is less than 20 mm, 15 mm, or 10 mm.

A8.2.1. The footwear (10) of paragraph A8.2, wherein each traction feature (78) of the plurality of traction features (78) is within 5 mm of another traction feature (78) of the plurality of traction features (78).

A8.3. The footwear (10) of any of paragraphs A8-A8.2.1, wherein each traction feature (78) has a depth that is less than 3 mm.

A8.4. The footwear (10) of any of paragraphs A8-A8.3, wherein each traction feature (78) of the plurality of traction features (78) is configured to deform against a ground surface when the footwear (10) is worn by a wearer and is urged against the ground surface.

A8.4.1. The footwear (10) of paragraph A8.4 when depending from paragraph A8.1, wherein the arcuate projections (80) of each pair of arcuate projections (80) are configured to deform in opposite directions when the footwear (10) is worn by the wearer and is urged against the ground surface.

A9. The footwear (10) of any of paragraphs A-A8.4.1, wherein the sole assembly (12) does not have any straight line tread features.

A10. The footwear (10) of any of paragraphs A-A9, wherein the sole assembly (12) does not have a heel-kick feature.

B. A method of manufacturing the footwear (10) of any of paragraphs A-A10, comprising:

operatively coupling the upper (16) to the sole assembly (12).

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the term "and/or" placed between a first entity and a second entity means one of (1) the first entity, (2) the second entity, and (3) the first entity and the second entity. Multiple entries listed with "and/or" should be construed in the same manner, i.e., "one or more" of the entities so conjoined. Other entities optionally may be present other than the entities specifically identified by the "and/or" clause, whether related or unrelated to those entities specifically identified. Thus, as a non-limiting example, a reference to "A and/or B," when used in conjunction with open-ended language such as "comprising," may refer, in one example, to A only (optionally including entities other than B); in another example, to B only (optionally including entities other than A); in yet another example, to both A and B (optionally including other entities). These entities may refer to elements, actions, structures, steps, operations, values, and the like.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

The invention claimed is:

1. Footwear, comprising:

a sole assembly having a ground-contacting side;

an upper coupled to the sole assembly opposite the ground-contacting side and defining a foot compartment configured to receive a wearer's foot; and a sockliner positioned within the upper above the sole assembly, wherein the sockliner defines a plurality of sockliner vents extending through the sockliner, wherein the plurality of sockliner vents have a plurality of different sizes, wherein the plurality of sockliner vents comprises a first subset of larger sockliner vents and a second subset of smaller sockliner vents, and wherein the larger sockliner vents are larger than the smaller sockliner vents;

wherein the footwear has a forefoot region, a heel region, and a midfoot region between the forefoot region and the heel region;

wherein the sole assembly defines a plurality of sole-assembly vents extending through the sole assembly and open to the ground-contacting side and open to the foot compartment of the upper to provide direct and active ventilation to and from the foot compartment through the sole assembly; and wherein at least a subset of the first subset of the larger sockliner vents are vertically aligned with the plurality of sole-assembly vents.

2. The footwear of claim 1, wherein at least one sole-assembly vent of the plurality of sole-assembly vents extends through the forefoot region.

3. The footwear of claim 1, wherein at least one sole-assembly vent of the plurality of sole-assembly vents extends through the midfoot region.

4. The footwear of claim 1, wherein at least one sole-assembly vent of the plurality of sole-assembly vents extends through the heel region.

5. The footwear of claim 1, wherein at least one sole-assembly vent of the plurality of sole-assembly vents extends through the forefoot region, wherein at least one sole-assembly vent of the plurality of sole-assembly vents extends through the midfoot region, and wherein at least one sole-assembly vent of the plurality of sole-assembly vents extends through the heel region.

6. The footwear of claim 1 wherein the sole assembly comprises:

an outsole that defines the ground-contacting side; and a midsole positioned above the outsole; and wherein the plurality of sole-assembly vents comprises:

a plurality of outsole vent-portions defined by the outsole; and a plurality of midsole vent-portions defined by the midsole and vertically aligned with the outsole vent-portions.

7. The footwear of claim 6, wherein the plurality of outsole vent-portions and the plurality of midsole vent-portions each have a maximum lateral dimension in the range of 10 to 60 millimeters.

8. The footwear of claim 6, wherein the midsole vent-portions of the plurality of midsole vent-portions are wider toward the outsole than toward the foot compartment.

9. The footwear of claim 1, wherein at least one sole-assembly vent of the plurality of sole-assembly vents comprises a passage open to a lateral side and/or to a medial side of the sole assembly.

10. The footwear of claim 9, wherein the passage is positioned within the midfoot region.

11. The footwear of claim 1, wherein subsets of the second subset of smaller sockliner vents are clumped around respective sole-assembly vents of the plurality of sole-assembly vents, such that the subsets of the second subset of smaller sockliner vents are adjacent to, but not directly overlapping, the plurality of sole-assembly vents when the sockliner is installed within the footwear.

12. The footwear of claim 1, wherein the larger sockliner vents have a maximum lateral dimension of 2-7 millimeters, and wherein the smaller sockliner vents have a maximum lateral dimension of 0.5-3 millimeters.

13. The footwear of claim 1, wherein the sole assembly comprises:

an outsole that defines the ground-contacting side;

a midsole positioned above the outsole; and a moderator plate positioned within the midfoot region vertically above the midsole, wherein the moderator plate is more rigid than the midsole, wherein the moderator plate defines a plurality of moderator-plate vents, and wherein at least a subset of the moderator-plate vents is positioned vertically above at least one sole-assembly vent of the plurality of sole-assembly vents.

14. The footwear of claim 13, wherein the moderator plate is disposed only within the midfoot region.

15. The footwear of claim 13, wherein at least one sole-assembly vent of the plurality of sole-assembly vents extends through the midfoot region; and wherein the moderator plate is visible through the at least one sole-assembly vent of the plurality of sole-assembly vents that extends through the midfoot region.

16. The footwear of claim 1, further comprising a Strobel board, wherein the upper is coupled to the Strobel board to define the foot compartment, wherein the upper and the Strobel board are coupled to the sole assembly, and wherein the Strobel board defines a plurality of Strobel board vents.

17. The footwear of claim 16, wherein the plurality of Strobel board vents spans a majority of the Strobel board.

18. The footwear of claim 16, wherein the Strobel board is constructed at least partially of a mesh material, and wherein the mesh material spans at least 75% of the Strobel board.

19. The footwear of claim 1, wherein the plurality of sockliner vents defines one or more clusters, each vertically centered at a respective sole-assembly vent.

20. The footwear of claim 19, wherein a greatest concentration of sockliner vents of the plurality of sockliner vents is disposed at portions of the sockliner that are vertically aligned with a respective sole-assembly vent when the sockliner is installed in a default position, and wherein the sockliner vents of the plurality of sockliner vents are less concentrated at portions of the sockliner that are adjacent to, but not directly overlapping, the plurality of sole-assembly vents when the sockliner is installed within the footwear.

21. The footwear of claim 1, wherein the sockliner comprises a resilient material, such that compression of the sockliner directly above one or more sole-assembly vents of the plurality of sole assembly vents is configured to push warm air out of the foot compartment, and wherein expansion of the sockliner directly above one or more sole-assembly vents of the plurality of sole assembly vents is configured to pull cool air through the one or more sole-assembly vents of the plurality of sole assembly vents and into the foot compartment.

22. Footwear, comprising:

a sole assembly having a ground-contacting side;

an upper coupled to the sole assembly opposite the ground-contacting side and defining a foot compartment configured to receive a wearer's foot; and a sockliner positioned within the upper above the sole assembly, wherein the sockliner defines a plurality of sockliner vents extending through the sockliner, wherein the plurality of sockliner vents have a plurality of different sizes, wherein the plurality of sockliner vents comprises a first subset of larger sockliner vents and a second subset of smaller sockliner vents, and wherein the larger sockliner vents are larger than the smaller sockliner vents;

wherein the footwear has a forefoot region, a heel region, and a midfoot region between the forefoot region and the heel region;

wherein the sole assembly defines a plurality of sole-assembly vents extending through the sole assembly and open to the ground-contacting side and open to the foot compartment of the upper to provide direct and active ventilation to and from the foot compartment through the sole assembly;

wherein at least a subset of the larger sockliner vents are concentrated above the plurality of sole-assembly vents, such that at least one larger sockliner vent of the first subset of the larger sockliner vents is vertically aligned with at least one sole-assembly vent of the plurality of sole-assembly vents at any given time.

23. Footwear, comprising:

a sole assembly having a ground-contacting side;

an upper coupled to the sole assembly opposite the ground-contacting side and defining a foot compartment configured to receive a wearer's foot; and a sockliner positioned within the upper above the sole assembly, wherein the sockliner defines a plurality of sockliner vents extending through the sockliner, wherein the plurality of sockliner vents have a plurality of different sizes, wherein the plurality of sockliner vents comprises a first subset of larger sockliner vents and a second subset of smaller sockliner vents, and wherein the larger sockliner vents are larger than the smaller sockliner vents;

wherein the footwear has a forefoot region, a heel region, and a midfoot region between the forefoot region and the heel region;

wherein the sole assembly defines a plurality of sole-assembly vents extending through the sole assembly and open to the ground-contacting side and open to the foot compartment of the upper to provide direct and active ventilation to and from the foot compartment through the sole assembly;

wherein the plurality of sockliner vents defines one or more clusters, each vertically centered at a respective sole-assembly vent; and wherein a greatest concentration of sockliner vents of the plurality of sockliner vents is disposed at portions of the sockliner that are vertically aligned with a respective sole-assembly vent when the sockliner is installed in a default position, and wherein the sockliner vents of the plurality of sockliner vents are less concentrated at portions of the sockliner that are adjacent to, but not directly overlapping, the plurality of sole-assembly vents when the sockliner is installed within the footwear.

24. Footwear, comprising:

a sole assembly having a ground-contacting side; and an upper coupled to the sole assembly opposite the ground-contacting side and defining a foot compartment configured to receive a wearer's foot;

wherein the footwear has a forefoot region, a heel region, and a midfoot region between the forefoot region and the heel region;

wherein the sole assembly defines a plurality of sole-assembly vents extending through the sole assembly and open to the ground-contacting side and open to the foot compartment of the upper to provide direct and active ventilation to and from the foot compartment through the sole assembly; and wherein the sole assembly comprises:

an outsole that defines the ground-contacting side;

a midsole positioned above the outsole; and a moderator plate positioned within the midfoot region vertically above the midsole, wherein the moderator plate is more rigid than the midsole, wherein the moderator plate defines a plurality of moderator-plate vents, and wherein at least a subset of the moderator-plate vents is positioned vertically above at least one sole-assembly vent of the plurality of sole-assembly vents.

25. The footwear of claim 24, wherein at least one sole-assembly vent of the plurality of sole-assembly vents extends through the midfoot region; and wherein the moderator plate is visible through the at least one sole-assembly vent of the plurality of sole-assembly vents that extends through the midfoot region.

26. The footwear of claim 24, wherein the moderator plate is disposed only within the midfoot region.

27. The footwear of claim 24, wherein at least one sole-assembly vent of the plurality of sole-assembly vents comprises a passage open to a lateral side and/or to a medial side of the sole assembly; and wherein the passage is defined between the moderator plate and the midsole.

28. Footwear, comprising:

a sole assembly having a ground-contacting side; and an upper coupled to the sole assembly opposite the ground-contacting side and defining a foot compartment configured to receive a wearer's foot;

wherein the footwear has a forefoot region, a heel region, and a midfoot region between the forefoot region and the heel region;

wherein the sole assembly defines a plurality of sole-assembly vents extending through the sole assembly and open to the ground-contacting side and open to the foot compartment of the upper to provide direct and active ventilation to and from the foot compartment through the sole assembly;

wherein the sole assembly comprises:

an outsole that defines the ground-contacting side; and a midsole positioned above the outsole;

wherein the plurality of sole-assembly vents comprises:

a plurality of outsole vent-portions defined by the outsole; and a plurality of midsole vent-portions defined by the midsole and vertically aligned with the outsole vent-portions; and wherein the midsole vent-portions of the plurality of midsole vent-portions are wider toward the outsole than toward the foot compartment.

* * * * *